US005372516A

United States Patent [19]

Maeda

[11] Patent Number: 5,372,516

[45] Date of Patent: Dec. 13, 1994

[54] WATERPROOF CONNECTOR

[75] Inventor: Akira Maeda, Shizuoka, Japan

[73] Assignee: Yazaki Corporation, Japan

[21] Appl. No.: 983,465

[22] Filed: Nov. 30, 1992

[30] Foreign Application Priority Data

Nov. 29, 1991 [JP] Japan ..... 3-316870

[51] Int. Cl.[5] ..... H01R 13/52

[52] U.S. Cl. ..... 439/271

[58] Field of Search ..... 439/271–282

[56] References Cited

U.S. PATENT DOCUMENTS 3,077,572 2/1963 Zimmerman, Jr. ..... 439/866
4,695,259 9/1987 Uchida ..... 439/271

FOREIGN PATENT DOCUMENTS 1026390 3/1958 Germany ..... 439/271
323668 5/1991 Japan .
988775 4/1965 United Kingdom ..... 439/271

*Primary Examiner*—P. W. Echols
*Attorney, Agent, or Firm*—Wigman, Cohen, Leitner & Myers

[57] ABSTRACT

A waterproof connector receiving a terminal connected to an electric wire comprises a housing for receiving the terminal. The housing has an opening portion into which the terminal and the electric wire are inserted. The waterproof connector also comprises a sealing member made of an elastic material to be inserted into the opening portion. The sealing member comprises an insertion hole for inserting the electric wire thereinto and a circular projected portion expanded from an external periphery of the sealing member. An inner diameter of the insertion hole is equal to or larger than an outer diameter of the electric wire, and the extreme outer diameter of the projected portion is larger than the inner diameter of the opening portion.

3 Claims, 3 Drawing Sheets

WATERPROOF CONNECTOR

BACKGROUND OF THE INVENTION

This invention relates to a waterproof connector in which a sealing member is interposed between a connector housing and an electric wire.

In a connector for interconnecting the electric wires, a crimp-style terminal is engaged therein to fix both ends of the wires to be interconnected. In order to prevent entrance of the water into the space or clearance within the connector where the crimp-style terminal is located, some connectors have a sealing member fitted into the connector housing.

FIG. 1 is a sectional view of a female connector having the sealing member therein. The electric wire 3 is inserted into a connector housing 1. The end of the electric wire 3 is connected to a crimp-style terminal 5 which is engaged with the connector housing 1. A rubber plug 7 is interposed between an insulation portion 3*a* of the electric wire 3 and the connector housing 1.

The rubber plug 7 comprises an electric wire insertion hole 7*a* passing therethrough. The diameter of the electric wire insertion hole 7*a* is slightly smaller than that of the insulation portion 3*a*. By means of forcing the electric wire 3 into the electric wire insertion hole 7*a*, sealing performance therebetween can be secured. Subsequently, the electric wire 3 are inserted into the connector housing 1 in this condition. Further, the rubber plug 7 is crushed in the connector housing 1, thereby the sealing performance can be exhibited to prevent entrance of the water into the inside of the connector housing where the crimp-style terminal 5 is disposed.

However, in case where a thin electric wire 3 having relatively small diameter is applied, as shown in FIG. 1, may result in a clearance t between the thin electric wire 3 and the rubber plug 7. This results in poor sealing performance.

Such rubber plug is made by using a mold 11 as illustrated in FIG. 2. The mold 11 comprises a piece 11*a* to form the electric wire insertion hole 7*a*. In order to overcome the above mentioned problem of the clearance and secure sufficient crushing of the rubber plug 7, a diameter of the piece should be further reduced. However, the piece 11*a* of excessively small diameter tends to be broken on making the rubber plug 7, causing inadequate productivity for the rubber plug 7. Thus, there is the limitation to an internal dimension u of the insertion hole 7*a* of the rubber plug 7.

SUMMARY OF THE INVENTION

It is an object of the present invention to provide a waterproof connector having sufficient sealing performance.

It is another object of the present invention to provide a waterproof connector where the thin electric wire can be applied without affecting the productivity of the sealing member. In order to achieve the above mentioned objects, the present invention provides a waterproof connector receiving a terminal connected to an electric wire, comprising:

a housing for receiving the terminal, the housing having an opening portion into which the terminal and the electric wire are inserted; and a sealing member made of an elastic material to be inserted into the opening portion, the sealing member having an insertion hole for inserting the electric wire thereinto and a circular projected portion expanded from an external periphery thereof, an inner diameter of the insertion bole being equal to or larger than an outer diameter of the electric wire, and the extreme outer diameter of the projected portion being larger than the inner diameter of the opening portion.

According to the waterproof connector having the above mentioned structure, the outer diameter of the peripheral projection of the sealing member is larger than the inner diameter of the opening portion of the connector housing. The projection is forced to an internal surface of the opening when the sealing member is inserted into the connector housing. In addition, the internal surface of the insertion hole for the sealing member is protruded toward the electric wire and adhered thereto. Thus, the sealing performance can be secured. Therefore, it is possible to determine the relatively larger diameter of the insertion hole to that of the electric wire. As a result, the piece of the mold for use in producing the sealing member can be relatively large in diameter for forming the electric wire insertion hole. Thus, it is possible to prevent breakdown of the piece on molding. In addition, the larger diameter of the insertion hole than that of the electric wire contributes to facilitating inserting operation of the electric wire to the hole.

DESCRIPTION OF THE PREFERRED EMBODIMENT

Figure 1:
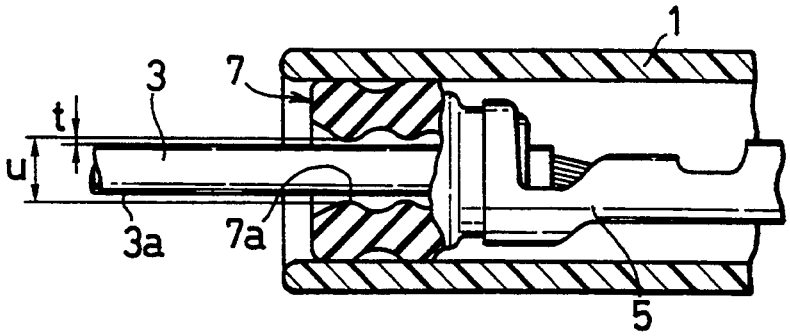
FIG.1 PRIOR ART
FIG. 1 is a sectional view of a main portion of the conventional waterproof connector where a rubber plug is applied and a thin electric wire is inserted thereinto.
Figure 2:
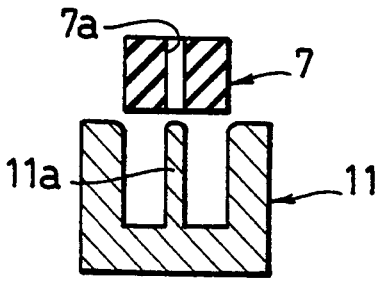
FIG.2 PRIOR ART
FIG. 2 is a schematic view illustrating the rubber plug shown in FIG. 1 and a mold for molding the rubber plug.

A waterproof connector of the present invention will be described below with reference to the drawing.

Figure 3:
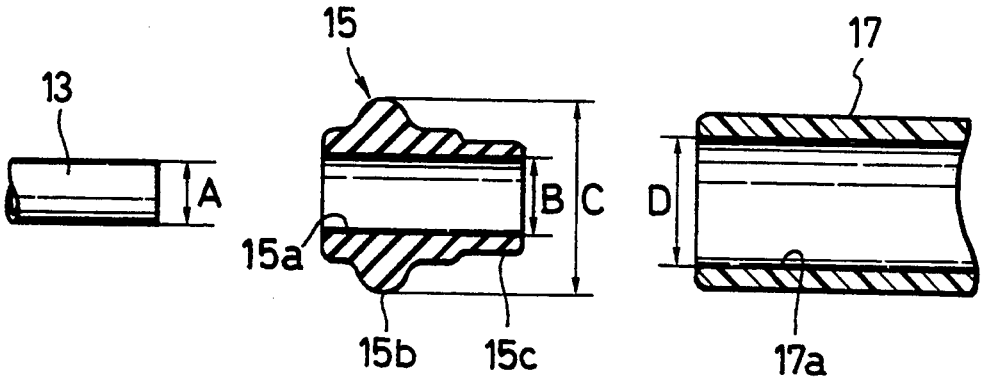
FIG. 3 shows a waterproof connector according to a first embodiment of the present invention, in which the rubber plug and a connector housing are illustrated for use in describing the relation between the dimensions thereof.
Figure 4:
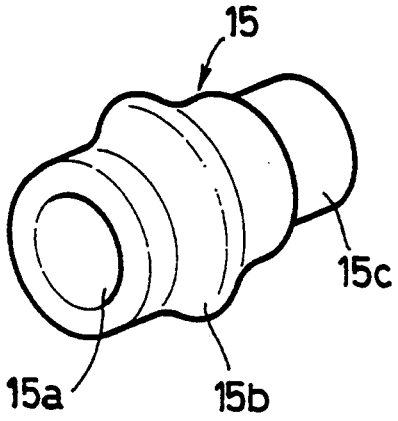
FIG. 4 is a perspective view of the rubber plug illustrated in FIG. 3.
Figure 5:
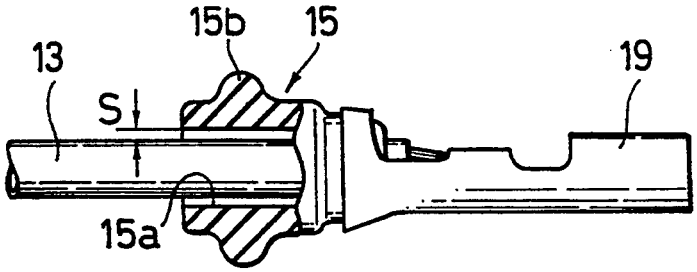
FIG. 5 shows an assembly of the rubber plug and the electric wire inserted thereinto.

FIG. 3 is a view for use in describing the dimensional relation between a thin electric wire 13, a rubber plug 15 which is shown in FIG. 4 as the perspective view and a connector housing 17. The rubber plug 15 serves as a searing member and has an insertion hole 15*a* where the thin electric wire 13 is inserted. The connector housing 17 comprises an opening portion 17*a* where the thin electric wire 13 inserted with the rubber plug 15. In the figure, the inner diameter B of the insertion hole 15*a* of the rubber plug 15 is equal to or larger than the diameter A of the covered portion of the electric wire 13. In addition, the outer diameter C of the circular external projection 15*b* formed on the periphery of the rubber plug 15 is larger than the inner diameter D of the opening portion 17*a* of the connector housing 17, in other words, the dimensional relation of each diameter is $A \leqq B < D < C$. The rubber plug 15 comprises, as illustrated in FIG. 5, the insertion hole 15*a*, the external projection 15*b* and a small-diameter portion 15*c*. The insertion hole 15*a* penetrates through the rubber plug 15 in the longitudinal direction. The external projection 15*b* is protruded on the peripheral surface of the plug 15. The small-diameter portion 15*c* has the relatively small diameter as compared with the remaining portion of the plug 15.

Figure 6:
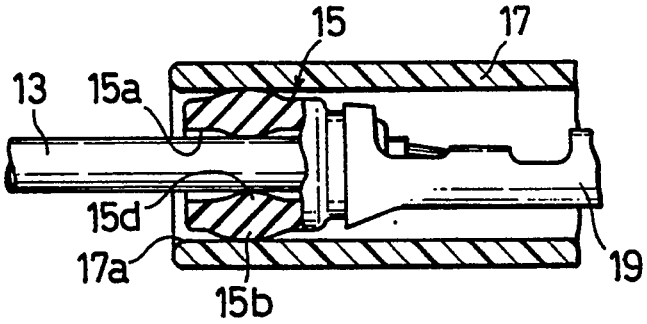
FIG. 6 is a sectional view of the connector housing with the assembly illustrated in FIG. 5 attached therein.

FIG. 5 shows the assembly in which the covered portion of the thin electric wire 13 is inserted into the insertion hole 15*a* of the rubber plug 15 and a crimp-style terminal 19 is connected to the end of the thin electric wire 13. The crimp-style terminal 19 forces the small-diameter portion 15*c* of the rubber plug 15 from the periphery thereof to fix the rubber plug 15. In this state, a space $s=(B-A)/2$ exists between the internal surface of the insertion hole 15*a* of the rubber plug 15 and the thin electric wire 13 (provided when $A=B$, S is equal to zero). The assembly consists of the thin electric wire 13, the rubber plug 15 and the crimp-style terminal 19. This assembly is inserted into the opening portion 17*a* of the connector housing 17 as illustrated in FIG. 6 to fit the rubber plug 15 to the opening portion 17*a*. As a result, the external projection 15*b* is forced to the internal surface of the opening portion 17*a*. The outer dimension of the external projection 15*b* is reduced to deform the rubber plug 15. Accompanying with this, the internal surface of the insertion hole 15*a* corresponding to the external projection 15*b* of the rubber plug 15 is expanded towards the thin electric wire 13 to form a circular internal projection 15*d*.

Figure 7:
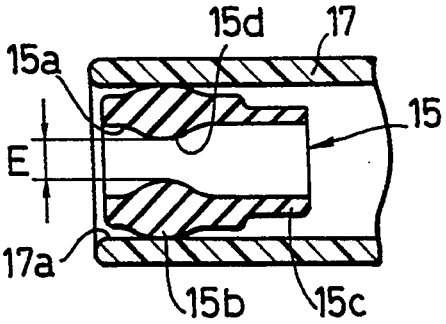
FIG. 7 is a sectional view of the connector housing only with the single rubber plug illustrated in FIG. 6 inserted thereinto.

FIG. 7 shows the connector housing 17 only with the single rubber plug 15 is fitted to the opening portion 17*a*. In this event, the internal projection 15*d* is formed on the internal surface of the insertion hole 15*a*. The inner diameter E of the internal projection 15*d* is determined such that it becomes smaller than the diameter A (namely, $E<A$) of the covered portion of the thin electric wire 13.

Thus, the circular internal projection 15*d* formed on the rubber plug 15 contributes to securing the sealing performance to the thin electric wire 13 by means of adhering thereto as illustrated in FIG. 6. In addition, the circular external projection 15*b* formed on the periphery of the rubber plug 15 contributes to securing the sealing performance to the thin electric wire 13 by means of adhering thereto.

As mentioned above, it is possible to produce the relatively large rubber plug 15 with which complete sealing performance can be exhibited. Such rubber plug 15 can be achieved by means of forming the insertion hole 15*a* of the inner diameter B which is larger than the diameter A of the covered portion of the thin electric wire 13. As a result, the piece of the mold for use in producing the sealing member can be relatively large in diameter for forming the electric wire insertion hole. Thus, it is possible to prevent broken down of the piece on molding. In addition, the thin electric wire 13 can be readily inserted into the insertion hole 15*a*, resulting in improvement of the operational efficiency.

Figure 8:
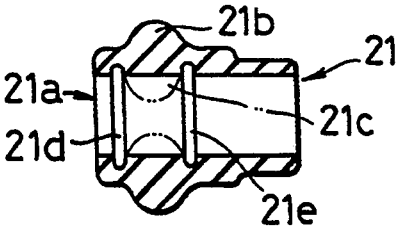
FIG. 8 is a sectional view showing a rubber plug according to another embodiment of the present invention.

FIG. 8 shows another embodiment of the rubber plug which serves as the sealing member. In an internal surface of an insertion hole 21*a* of a rubber plug 21, circular slots 21*d* and 21*e* are formed at a position close to both ends of an internal projection 21*c* in the longitudinal direction. Such internal projection 21 is formed due to crush of an external projection 21*b*. By means of forming the slots 21*d* and 21*e*, the external projection 21*b* is more readily deformed when the rubber plug 21 is forced into the connector housing 17. As a result, less power is required to insert the rubber plug 21 into the connector housing 17, resulting in improvement of the efficiency of the assembling process.

While the preferred embodiment of the present invention has thus been described in conjunction with the rubber plug is used as the sealing member, other elastic material may be equally used as the sealing member such as a silicone resin.

What is claimed is:

1. A waterproof connector receiving a terminal connected to an electric wire, comprising:

a housing having a bore of a first internal diameter;

an axially extending seal member of an elastic material, for insertion into said housing bore, said seal member further including:

an internal bore adapted for receiving the electric wire and having an internal diameter at least as great as an external diameter of the wire, an enlarged external diameter portion disposed axially along the seal member length, said enlarged portion having a greater diameter than said housing bore and an axial dimension less than the seal member length, and an interior bore portion located opposite said enlarged external portion within said seal member internal bore;

wherein said interior bore portion is sealingly engaged against said wire by compression from said enlarged portion when the wire is installed inside the seal member and the seal member is installed inside the housing bore;

said seal member further including:

a pair of circular slots formed on the interior bore portion surface opposite respective axial ends of said enlarged portion.

2. A waterproof connector as claimed in claim 1, wherein said seal member is a rubber plug.

3. A waterproof connector as claimed in claim 1, wherein said seal member has a small-diameter portion which is held by means of the terminal when said electric wire is inserted into said insertion hole.

* * * * *